US005293177A

United States Patent [19]

Sakurai et al.

[11] Patent Number: 5,293,177

[45] Date of Patent: Mar. 8, 1994

[54] ANTENNA CONNECTOR

[75] Inventors: Kaoru Sakurai, Kawasaki; Hideki Watanabe, Yokohama, both of Japan

[73] Assignee: Nippon Sheet Glass Co., Ltd., Japan

[21] Appl. No.: 858,120

[22] Filed: Mar. 26, 1992

[30] Foreign Application Priority Data

Mar. 29, 1991 [JP] Japan ..... 3-20192[U]

[51] Int. Cl.[5] ..... H01Q 1/50

[52] U.S. Cl. ..... 343/906; 439/916; 439/578; 439/585

[58] Field of Search ..... 343/906, 905, 713; 439/578, 579, 581, 582, 585, 394, 916

[56] References Cited

U.S. PATENT DOCUMENTS 3,514,737 5/1970 Renshaw ..... 339/17
3,915,535 10/1975 O'Keefe et al. ..... 339/17
5,012,255 4/1991 Becker ..... 343/713

FOREIGN PATENT DOCUMENTS 0209974 1/1987 European Pat. Off. ..... H01R 17/12
0228750 7/1987 European Pat. Off. ..... H01R 9/05
9105118 6/1991 Fed. Rep. of Germany ..... H01Q 1/32
0223169 9/1990 Japan ..... 439/585
2210730 6/1989 United Kingdom ..... H01Q 1/32
2232827 12/1990 United Kingdom ..... 439/578

*Primary Examiner*—Donald Hajec
*Assistant Examiner*—Tan Ho
*Attorney, Agent, or Firm*—Ladas & Parry

[57] ABSTRACT

An antenna connector comprises a first housing for housing an end of a coaxial cable, first and second contact to be connected to a core wire and a shield wire, respectively, of the coaxial cable housed in the first housing, a second housing for housing the first housing, and a pair of conductive feeding metal plates. The feeding metal plates are arranged on and secured to a conductive antenna pattern formed on an insulative substrate and each of them has a first holder for receiving and holding the second housing and a second holder for receiving and holding the first and second contacts. When the first housing is housed in the second housing, the first and second contacts are engaged with and held by the second holder to plugably connect the coaxial cable to the antenna without disturbing an impedance matching and with a sufficient mechanical strength.

6 Claims, 3 Drawing Sheets

ANTENNA CONNECTOR

BACKGROUND OF THE INVENTION

1. Field of the Invention invention relates to a connector

The present for connecting an antenna and a cable, and more particularly to a connector for use in connecting a feeding cable to an antenna pattern formed on an insulative substrate (for example, a glass plate of a vehicle).

2. Related Background Art

As means for connecting a coaxial cable to an antenna pattern formed on a glass plate, a method of taking out a core wire and a shield wire by stripping off an end of the coaxial cable and soldering them directly to a pair of contacts of the antenna pattern (one of which is a ground contact to which the shield wire is to be connected), and a method connecting the shield wire to a body (for example, a body of a car) and connecting the core wire to a feeding point of the antenna pattern through an auxiliary substrate have been known.

In the former method, a process of stripping off the end of the coaxial cable and a termination-treatment of the wires take a long time, a mechanical strength of the contact points is weak, it is not possible to detach the cable from the antenna, and it is very inconvenient to carry the assembly. In the latter method, a sufficient impedance matching may not be attained because of a long distance between the end of the cable and the feeding point of the antenna, the mechanical strength is weak as it is in the first method (it is necessary to separately reinforce the auxiliary substrate by a tape), and it is not possible to detach the cable from the antenna.

SUMMARY OF THE INVENTION

In the light of the above, it is an object of the present invention to provide a connector which connects a coaxial cable to an antenna without disturbing an impedance matching with a sufficient mechanical strength and which permits the detachment of the cable from the antenna.

In order to achieve the above object, the antenna connector of the present invention comprises a first housing for housing an end of a cable, first and second contacts to be connected to a core wire and a shield wire, respectively, of the cable housed in the first housing, a second housing for housing the first housing, and a pair of conductive feeding metal plates arranged on and secured to a conductive antenna pattern formed on an insulative substrate and each having a first holder for receiving and holding the second housing and a second holder for receiving and holding the first and second contacts.

DETAILED DESCRIPTION OF THE PREFERRED EMBODIMENTS

Figure 1:
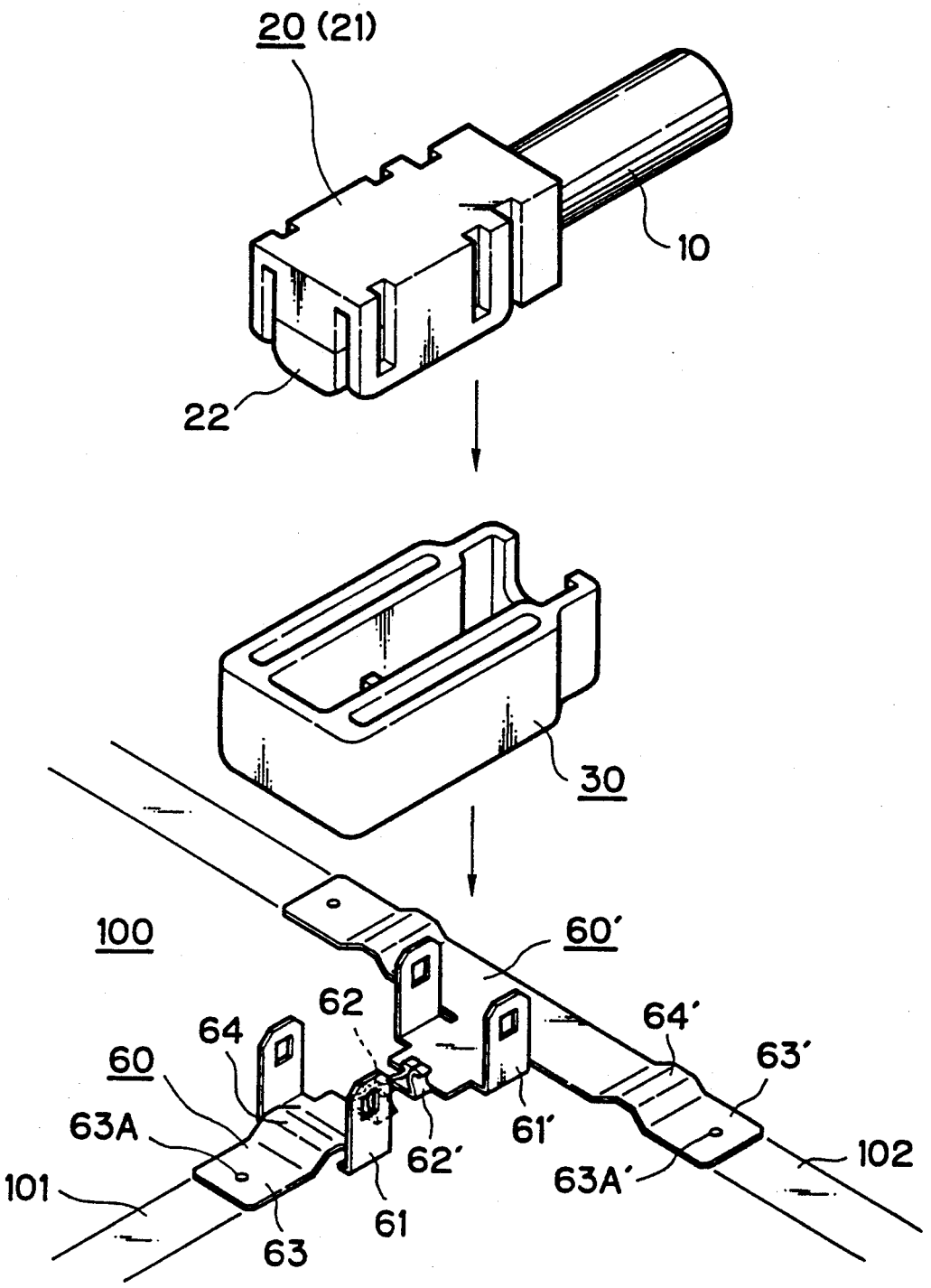
FIG. 1 shows a developed view of an embodiment of an antenna connector of the present invention.

FIG. 1 shows a developed view of one embodiment of the antenna connector of the present invention. As shown, the antenna connector comprises a first housing 20 for housing an end of a coaxial cable 10, a second housing 30 for housing the first housing 20, and a pair of conductive feeding metal plates 60.

Figure 2:
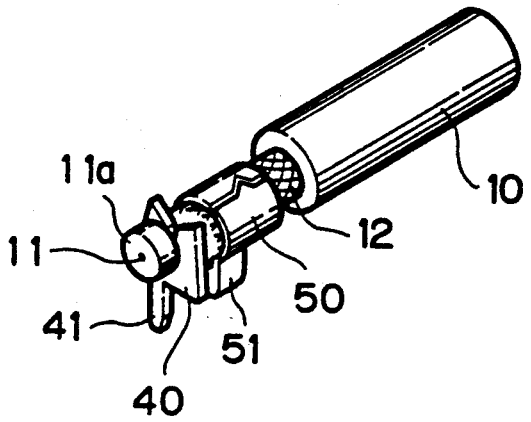
FIG. 2 shows a perspective view of an end of a coaxial cable of the antenna connector of FIG. 1.

FIG. 2 shows a detail of the end of the coaxial cable 10 to be housed in the first housing 20. As shown, a first contact (press-fit or press-contacted contact) 40 extends through a coating 11*a* of a core wire 11 of the coaxial cable to contact to the core wire, and a second contact (press-attached contact) 50 calks the shield wire 12. The first and second contacts 40 and 50 are externally accessable and have connecting members 41 and 51 protruded downward for connection with second holders 62 and 62' of a feeding metal plate to be described later. In the present invention, the shape and position of the connecting members are not restrictive.

Figure 3:
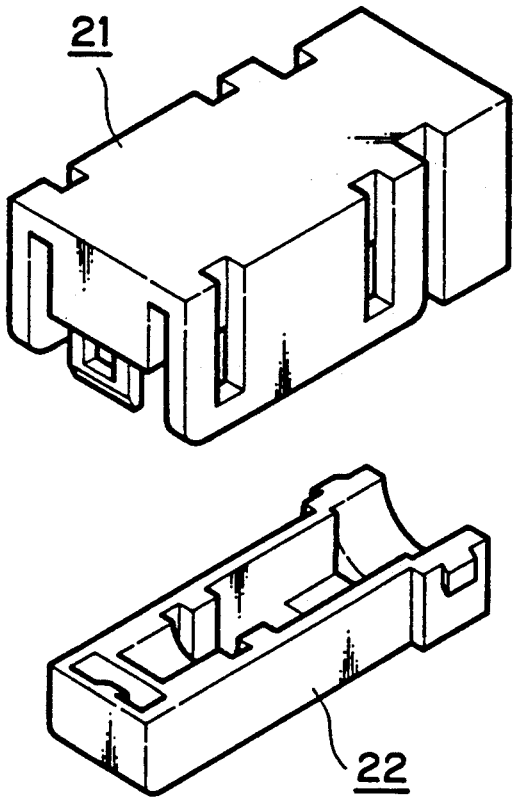
FIG. 3 shows a developed view of a first housing of the antenna connector of FIG. 1.

As shown in FIG. 3, the first housing 20 comprises upper and lower members 21 and 22. In the present embodiment, they are separate from each other, although the may be linked at their tops (which serve as a hinge).

Turning back to FIG. 1, the pair of feeding metal plates 60 and 60' are arranged in a generally T-shape on conductive antenna patterns 101 and 102 formed on a glass plate 100, and they are plane-contacted and soldered to the conductive antenna pattern at ends 63 and 63' of branches.

The pair of feeding metal plates 60 and 60' have first holders 61 and 61' for receiving and holding the second housing 30, and second holders 62 and 62' for accessing to the first and second contacts 40 and 50 to receive and hold the first and second contacts (in the present embodiment, through the connecting elements 41 and 51 of the contacts), respectively.

The branches of the generally T-shaped feeding metal plates have kinks or crank-shaped grooves 64 and 64' formed to extend outward across the ends of the branches. The grooves prevent preparatory solders applied to the ends of the branches of the feeding metal plates 60 and 60' from flowing out. Projections 63A and 63A' are formed on the soldering planes of the ends of the branches which face the antenna patterns 101 and 102 to prevent crack which may other-wire be caused by a difference among thermal expansions of the feeding metal plate, to solder and the glass.

Figure 4:
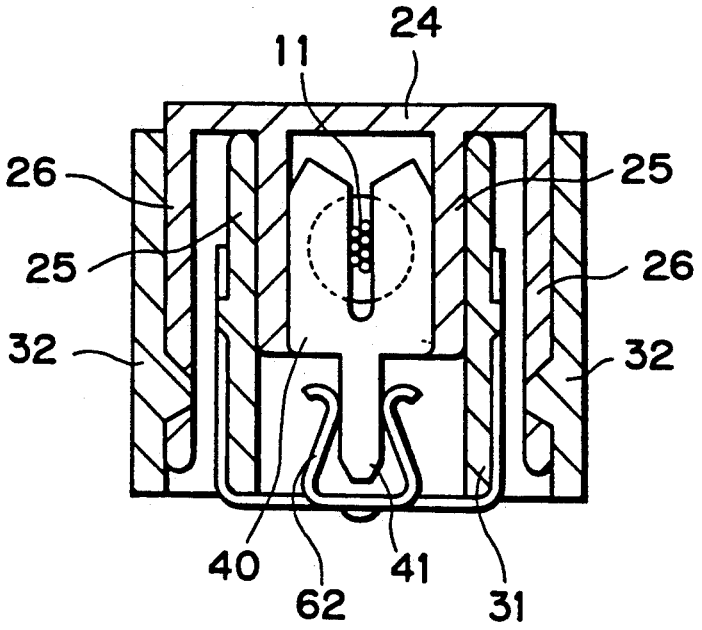
FIG. 4 shows a sectional view to illustrate a position in use of the antenna connector of FIG. 1.
Figure 5:
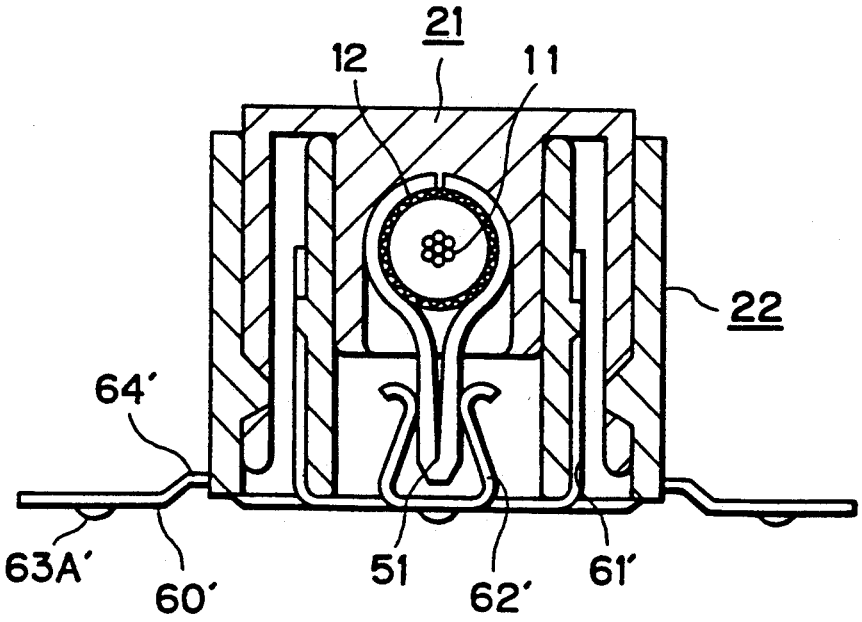
FIG. 5 shows a sectional view different from that of FIG. 4 to illustrate a position in use of the antenna connector of FIG. 1.

FIGS. 4 and 5 show sectional views when the first housing 20 which houses the coaxial cable is housed in the second housing 30. They also show sectional views when the first housing is mounted on and held by the feeding metal plates 60 and 60'. FIG. 4 shows a sectional view taken along a plane containing the first contact 40, and FIG. 5 shows a sectional view taken along a plane containing the second contact 50.

In FIG. 4, the first housing 20 comprises a first wall plane 24 which defines a top, a pair of opposing second wall planes 25 which define a cavity to house the coaxial cable and a pair of opposing third wall planes 26 externally of the second wall planes 25. The second housing 30 is of bottomless structure and comprises a pair of inner wall planes 31 which engage with the first holders 61 and 61' (which form a pair of opposing holding members) of the feeding metal plates 60 and 60', and a pair of outer wall planes 32 which are externally of the pair of inner wall planes 31 and engage with the third wall planes 26 of the first housing.

As shown in FIG. 4, the first contact 40 which is press-contacted to the core wire 11 of the coaxial cable is connected to and held by the second holder 62 of the feeding metal plate (which forms a pair of leaf springs) through the connecting member (downwardly extending tongue) 41.

As shown in FIG. 5, the second contact 50 which is press-attached to the shield wire 12 of the coaxial cable is connected to and held by the second holder 62' of the feeding metal plate (which forms a pair of leaf springs) through the connecting member (downwardly extending tongue) 51.

When the antenna connector of the present invention is to be actually used, the feeding metal plates 60 and 60' are arranged on and secured to the conductive antenna pattern on the glass plate, and the second housing 30 is mounted on and held by the feeding metal plates 60 and 60'. On the other hand, the first housing 20 which houses the end of the coaxial cable 10 is housed in the second housing 30 mounted on and held by the feeding metal plates 60 and 60'. Thus, the first and second contacts 40 and 50 connected to the core wire and the shield wire of the coaxial cable, respectively, are engaged with and held by the second holders 62 and 62' of the feeding metal plates.

Since the feeding metal plates 60 and 60' of the antenna connector of the present invention are of generally T-shape, the metal plates may make plane-contact to the glass plane at at least three points on the branch of each of the metal plates. Accordingly, the connector can be attached to the glass plane with a large mechanical strength.

Further, in the antenna connector of the present invention, the first housing 20 which houses the coaxial cable 10 is housed in the second housing 30. Accordingly, the contact pair 40 and 50 which are connected to the core wire and the shield wire of the coaxial cable 10, respectively, are protected from the external.

The second housing 30 is held by the feeding metal plate formed on the glass plate to form the connector on the glass plate, the first housing 20 which houses the coaxial cable 10 is used as the connector for the cable, and the cable connector and the connector on the glass plate are plugged in and out so that the attachment and detachment of the cable connector and the antenna connector are attained.

When the first housing 20 is housed in the second housing 30, the first and second contacts 40 and 50 are connected to the second holders 62 and 62' of the feeding metal plates 60 and 60'. Thus, the second housing 30 serves as a guide to correctly guide the contacts 40 and 50 to the holders 62 and 62' of the metal plates. Accordingly, when the cable connector is attached to or detached from the connector on the glass plate, there is no risk of twisting the holders by the contacts 40 and 50.

As seen from FIGS. 4 and 5, in the antenna connector of the present invention, the distances between the first contact 40 which press-contacts the core wire of the cable and the metal contact 60 for receiving and holding the contact 40 and between the second contact 50 which press-attaches the shield wire and the metal plates 60' for receiving and holding the contact 50 may be sufficiently short. Accordingly, a sufficient impedance matching is attained in the antenna connector which handles a high frequency electromagnetic wave, and the connection with a small standing wave is attained.

In the embodiment of the present invention, the antenna which is connected to the antenna pattern formed on the window glass of the vehicle has been explained although the present invention is not limited thereto but various modifications such as the connection with the antenna pattern formed on other insulative substrate may be made.

What is claimed is:

1. An antenna connector comprising:

a first housing for housing an end of a feeding cable;

first and second contacts to be connected to a core wire and a shield wire, respectively, of the cable housed in said first housing;

a second housing for housing said first housing; and a pair of conductive feeding metal plates being arranged on and secured to a conductive antenna pattern formed on an insulative substrate and each having first hold means for receiving and holding said second housing and second hold means for receiving and holding said first and second contacts, wherein said feeding metal plates form together a general T-shape and ends of branches thereof are soldered to said conductive antenna pattern.

2. An antenna connector according to claim 1 wherein the branches of said feeding metal plates each has a kink or crank-shaped groove formed to outwardly protrude across the end of the branch.

3. An antenna connector according to claim 2 wherein said second hold means is formed closely to opposite sides of said feeding metal plates.

4. An antenna connector according to claim 2 wherein the ends of the branches of said feeding metal plates each has a projection facing said conductive antenna pattern.

5. An antenna connector according to claim 4 wherein said second hold means is formed closely to opposite sides of said feeding metal plates.

6. An antenna connector according to claim 1 wherein said second hold means is formed closely to opposite sides of said feeding metal plates.

* * * * *